United States Patent [19]

Welte

[11] 4,008,122

[45] Feb. 15, 1977

[54] PAPER MAKING MACHINE WITH FACING FELT AND FORMING WIRE

[75] Inventor: Ernst Welte, Ravensburg, Germany

[73] Assignee: Escher Wyss G.m.b.H., Ravensburg, Germany

[22] Filed: Mar. 26, 1975

[21] Appl. No.: 562,058

[30] Foreign Application Priority Data

Apr. 9, 1974 Switzerland ..... 4985/74

[52] U.S. Cl. ..... 162/290; 162/301; 162/306; 162/307; 162/359

[51] Int. Cl.[2] ..... D21F 9/00

[58] Field of Search ..... 162/290, 305, 306, 307, 162/359, 206, 207, 317, 203, 301, 360 R; 100/93 RP; 34/123, 152

[56] References Cited

UNITED STATES PATENTS

| | | | |
|---|---|---|---|
| 2,730,933 | 1/1956 | Reynolds | 162/307 X |
| 3,378,435 | 4/1968 | Loynd | 162/317 X |
| 3,434,922 | 3/1969 | Ely | 162/203 X |
| 3,531,371 | 9/1970 | Jordansson et al. | 162/290 X |
| 3,691,010 | 9/1972 | Krake | 162/206 |
| 3,694,311 | 9/1972 | Skeppstedt | 162/290 |
| 3,846,228 | 11/1974 | Ely et al. | 162/290 X |

*Primary Examiner*—Robert L. Lindsay, Jr.
*Assistant Examiner*—Richard V. Fisher
*Attorney, Agent, or Firm*—Kenyon & Kenyon Reilly Carr & Chapin

[57] ABSTRACT

The paper making machine is of compact construction and uses a suction roll as a guide roll for the felt web to aid in removing the paper web from the wire to the felt web and to press the felt web and paper web against the drying roll to aid in transferring the paper web to the drying roll. Secondary pressure rolls may also be used downstream of the suction roll for dewatering purposes. Also, a blower means is used to assist transfer of the paper web from the wire to the felt web.

8 Claims, 2 Drawing Figures

PAPER MAKING MACHINE WITH FACING FELT AND FORMING WIRE

Figure 1:
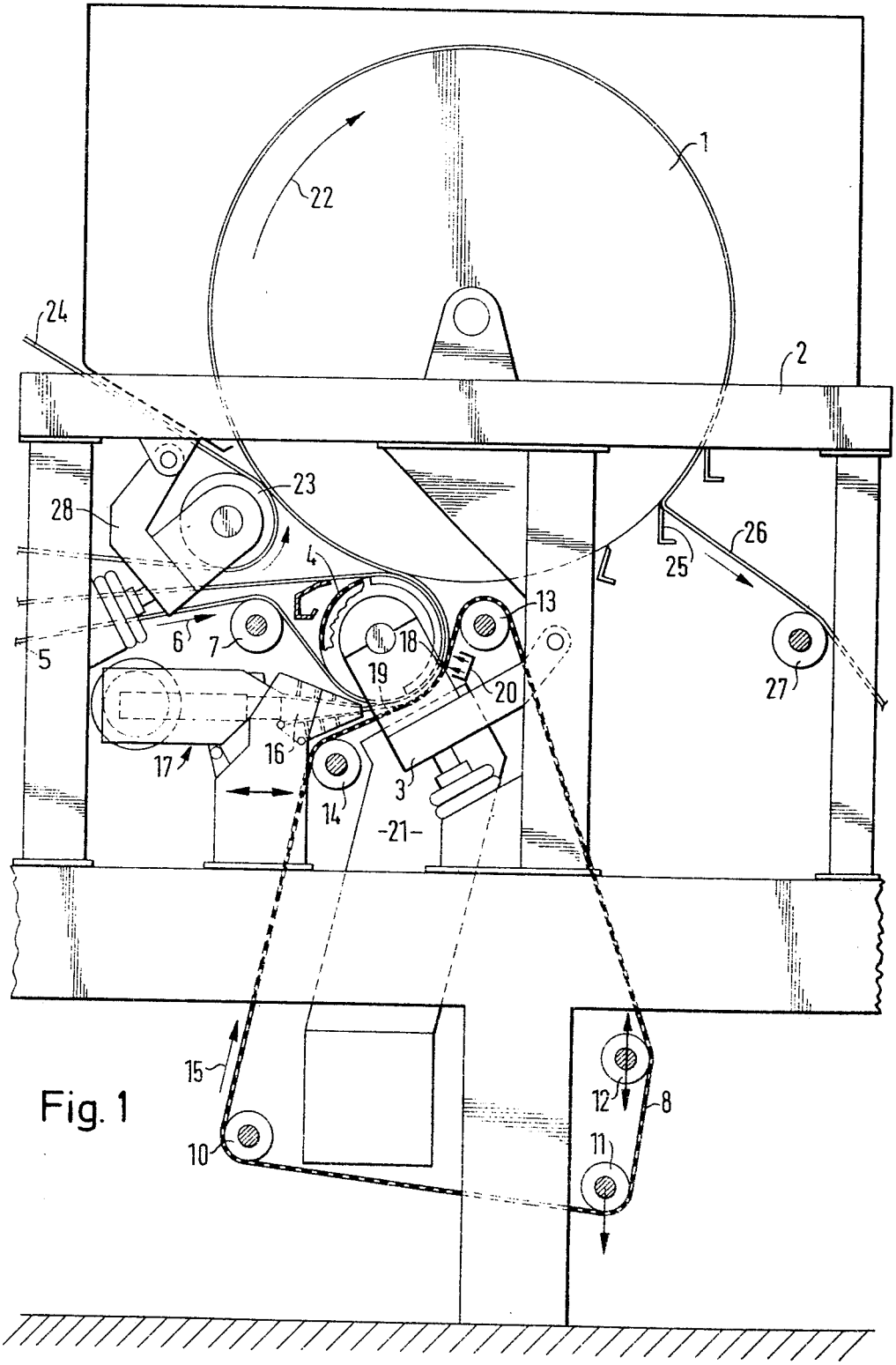

This invention relates to a paper making machine and particularly to a tissue paper machine.

As is known, tissue paper making machines generally use a breast box system to supply a stock suspension between a wire and a felt web so that a paper web may be formed. Use is also made of a drying roll or a glazing roll to receive the paper web from the wire in order to complete the formation of the paper web. In addition, various guide rolls have been employed to guide the felt web in the direction of movement of the wire.

In machines of this kind, the paper web is formed on a wire and then removed from the wire by the take-off felt web and transferred to the drying roll. However, difficulties frequently arise, on the one hand, in connection with the transfer of the paper web from the wire to the felt web and, on the other hand, with the transfer of the paper web from the felt web to the roll.

U.S. Pat. No. 3,378,435 discloses a paper-making machine of this kind wherein the problems associated with the transfer of the paper web from the wire to the felt web are obviated by the use of a breast box system which delivers pulp between the wire and the felt web which pass jointly over a roll at this point. This system, however, obviates only some of the associated problems and does not eliminate the disadvantage that the machine is relatively complex and requires considerable space.

Accordingly, it is an object of the invention to provide a paper-making machine which effects a reliable transfer of a paper web from a wire to a felt web and from the felt web to a drying roll.

It is another object of the invention to provide a paper making machine of compact construction.

It is another object of the invention to provide a paper making machine which is capable of allowing perfect web formation on a wire, transfer to a felt and thence transfer to a drying roll.

Briefly, the invention provides a paper making machine comprised of a breast box system for delivering paper pulp, a movable wire on one side of the breast box system to receive the pulp, a felt web on an opposite side of the breast box system in facing relation to the wire to form a paper web of the pulp between the wire and felt web, a drying roll and a plurality of guide rolls for guiding the felt web and the wire into facing relation with the wire pressed against the felt to form the paper web therebetween and to guide the felt web and wire away from each other to permit transfer of the paper web to the drying roll. In accordance with the invention, one of the guide rolls is positioned at a point of separation of the paper web from the wire and is pressed in the direction of the drying roll for pressing the felt web and paper web against the drying roll. This guide roll thus acts as a pressure roll for the drying roll.

This gives a compact machine construction and, in particular, requires much less space than the prior art machines. This greatly improves the transfer conditions for the web of the paper web from the wire to the felt web and from the felt web to the drying roll.

The felt web guide roll which is situated at the separation point may be constructed as a suction roll. In such an embodiment, not only is dewatering of the paper web improved, but the adhesion of the web to the felt web extending over the guide roll is also improved.

The lifting of the paper web from the wire is assisted as a result, thus eliminating one of the sources of trouble during operation. This is the case because the web has to be lifted away from the wire against centrifugal force which, when a suction roll is used, counteracts the negative pressure in the suction roll by means of which the web is drawn against the felt web.

In addition a blower means may be provided at the separation point on that side of the wire which is remote from the guide roll or suction roll to assist the removal of the paper fleece or web from the wire. This also assists the removal of the paper web from the wire while at the same time improving dewatering of the paper web. Optimum results are obtained if the blower means blows heated air against the paper web.

Preferably, the felt web and the wire form a wedge-shaped gap into which a duct of the breast box system leads. This gives very rapid dewatering of the web on both sides, through the felt and the wire, particularly if a suction roll is provided.

The wire may be disposed in a major part of its movement with associated guide rolls beneath the drying cylinder while the guide roll or suction roll between the wire and the drying roll is also situated beneath the drying roll. With this construction, the paper making machine occupies minimum floor space while operating satisfactorily. This, in turn, makes the installation costs very low.

In one embodiment, the felt web passes over a second pressure roll which is pressed against the drying cylinder by means of a pressure means. In such an embodiment, a single felt web is used to form two pressure points at which the paper web is dewatered by means of the felt web.

In another embodiment, a separate pressure felt is used which passes over a second pressure roll which is pressed against the drying roll by means of a pressure means.

Figure 2:
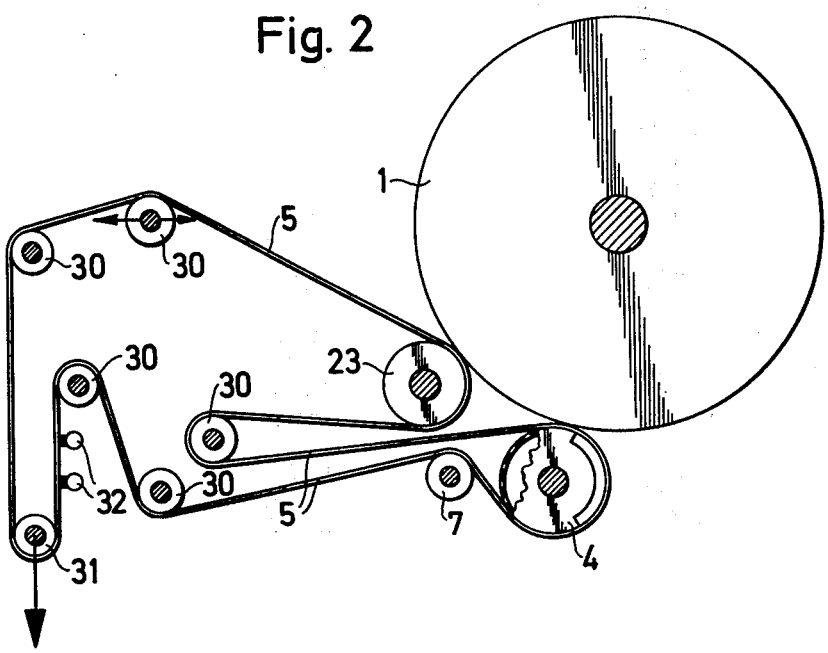

These and other objects and advantages of the invention will become more apparent from the following detailed description and appended claims taken in conjunction with the accompanying drawings in which:

FIG. 1 diagrammatically illustrates a paper making machine according to the invention; and FIG. 2 illustrates another embodiment of a paper making machine in which a single common felt passes over the guide roll and an additional pressure roll so as to form two pressure points in accordance with the invention.

Referring to FIG. 1, a paper making machine which is used for the production of tissue papers includes a heated drying roll 1 mounted rotatably on a support frame 2. In addition, a suction roll 4 is also mounted in the support frame 2 by means of a pressure device 3 which presses the roll 4 against the drying roll 1. A felt web 5 extends around the suction roll 4 which thus acts as a guide roll and, during operation, moves in the direction of the arrow 6 and passes over a guide roll 7 upstream of the suction roll 4. At the same time, a wire 8 passes over part of the circumference of the suction roll 4 and is guided over guide rolls 10, 11, 12, 13, 14 and is pressed, between the rolls 13 and 14, against the felt web 5 on the suction roll 4. The wire 8 is moved in the direction of the arrow 15 during operation.

The duct 16 of a breast box system 17 serving to form a paper web in the wedge-shaped gap 19 between the wire and the felt 5, is situated between the guide roll 14 for the wire 8 and the suction roll 4. A blower means 20 is mounted at a separation or lift-off point 18, where the wire 8 extends tangentially away from the circumference of the suction roll 4 and the paper web is lifted away from the wire 8 during operation. This blower means 20 is connected to a compressed air supply (not shown), which is preferably heated. A water discharge system 21 is also provided between the guide rolls 13 and 14 of the wire 8 to discharge water from the wire 8.

As will be apparent from FIG. 1, a pressure roll 23 is provided downstream of the suction roll 4 in the direction of rotation of the roll 1 and in the direction of movement of the paper web indicated by arrow 22, and is pressed against the drying roll 1 by a pressure means 28. A special pressure felt web 24 passes over the pressure roll 23 in this case. The two felt webs 5, 24 pass over dewatering and cleaning devices (not shown) in a manner known per se. The paper web 26 removed from the roll 1 by means of a scraper 25 is passed over a roll 27 and can be reeled in known manner by a reeling system (not shown).

During operation, the breast box system 17 and the wire 8 form a paper web, the wire water being displaced to both sides from the gap 19 and through the wire 8 and the felt web 5. This water is taken up by the felt web 5 upon forming and is transferred to the roll 1. This transfer is assisted, on the one hand, by the negative pressure in the suction roll 4 and by the positive pressure formed by the blower means 20. At the same time, the paper web undergoing formation is further dewatered. After the paper web 26 has been transferred from the felt web 5 to the roll 1, the paper web 26 passes through the pressure point for the roll 23 and is further pressed out and dewatered by the felt 24.

Referring to FIG. 2, wherein like reference characters indicate like parts as above, the second pressure felt web 24 may be eliminated and the felt web 5 additionally passed over the pressure roll 23. In this case, the felt web 5 extends over guide rolls 30, a loaded tensioning roll 31 and a dewatering and cleaning system 32.

Of course, the wire 8 may be provided with additional dewatering devices, which for reasons of clarity have been omitted from the example described.

What is claimed is:

1. A paper making machine comprising a breast box system having a duct for delivering paper pulp;

a movable wire on one side of said breast box system to receive the pulp;

a felt web on an opposite side of said breast box system in facing relation to said wire to form a paper web of the pulp between said wire and said felt web;

a drying roll; and a plurality of guide rolls (a) for guiding said felt web and said wire into facing relation with said felt and said wire passing over a part of the circumference of one of said rolls to press said wire against said felt web to form the paper web therebetween and (b) for guiding said felt web and said wire away from each other to permit transfer of the paper web to said drying roll from the felt web, said one of said guide rolls being positioned at a point of separation of the paper web from said wire and being pressed in the direction of said drying roll for pressing said felt web and the paper web against said drying roll.

2. A paper making machine as set forth in claim 1 wherein said one guide roll is a suction roll.

3. A paper making machine as set forth in claim 1 which further comprises a blower means at said separation point for assisting removal of the paper web from said wire, said blower means being disposed on a side of said wire remote from said one guide roll.

4. A paper making machine as set forth in claim 1 wherein said wire and said felt web form a wedge shaped gap into which said duct of said breast box system projects.

5. A paper making machine as set forth in claim 4 wherein said one guide roll is disposed below said drying roll and said wire is disposed in a major part of its movement below said one guide roll.

6. A paper making machine as set forth in claim 1 wherein said one guide roll is disposed below said drying roll and said wire is disposed in a major part of its movement below said one guide roll.

7. A paper making machine as set forth in claim 1 which further comprises a pressure roll downstream of said one guide roll relative to the direction of movement of the paper web for passage of said felt web thereover and means for pressing said pressure roll towards said drying roll to press said felt web and the paper web against said drying roll.

8. A paper making machine as set forth in claim 1 which further comprises a pressure roll downstream of said one guide roll relative to the direction of movement of the paper web, a second felt web passing around said pressure roll and means for pressing said pressure roll towards said drying roll to press said second felt web and the paper web against said drying roll.

* * * * *